US005799671A

United States Patent [19]

Takimae

[11] Patent Number: 5,799,671

[45] Date of Patent: Sep. 1, 1998

[54] CURLY HAIR CURLING IRON

[76] Inventor: Toyosaku Takimae, 12-11, Minami-Karasuyama 5-chome, Setagaya-ku, Tokyo, Japan

[21] Appl. No.: 851,894

[22] Filed: May 6, 1997

[30] Foreign Application Priority Data

May 23, 1996 [JP] Japan ..... 8-150412

[51] Int. Cl.[6] ..... A45D 2/40; A45D 2/42

[52] U.S. Cl. ..... 132/225; 132/224; 132/118; 219/225

[58] Field of Search ..... 132/118, 207, 132/223, 224, 122, 225, 229, 232, 269, 271; 219/222, 225, 226, 230

[56] References Cited

U.S. PATENT DOCUMENTS

| | | | |
|---|---|---|---|
| 1,927,709 | 9/1933 | Leuser | 132/118 |
| 4,242,567 | 12/1980 | Carter | 219/225 |
| 4,739,151 | 4/1988 | Smal | 132/225 |
| 4,819,674 | 4/1989 | Takimae | 132/224 |
| 5,357,988 | 10/1994 | Nakamura | 132/118 |
| 5,400,809 | 3/1995 | Adams | 132/118 |

*Primary Examiner*—Gene Mancene
*Assistant Examiner*—Pedro Philogene
*Attorney, Agent, or Firm*—Nikaido, Marmelstein, Murray & Oram LLP

[57] ABSTRACT

A curly hair curing iron having a jerking portion which does not exert a severing action on the hair and a stretching portion for making the hair straight. The iron is a scissors type iron having a rod housing with heaters therein. The inlet side constitutes the jerking portion having a strong gripping force. The outlet side constitutes the stretching portion having a weaker gripping force than the jerking portion. The jerking portion includes convex portions 8, 9 and 10 on one rod, and plane portions in engagement with the convex portions on the opposite rod. The stretching portion has a plurality of convex portions 11 on one rod which are square or trapezoidal in section and a plane on the other rod. Both the convex portions and the plane portions on both the jerking portion and the stretching portion are formed of an elastic material.

13 Claims, 3 Drawing Sheets

CURLY HAIR CURLING IRON

BACKGROUND OF THE INVENTION

1. Field of the Invention

The present invention relates to a curly hair curing iron for curing natural curly hair into straight hair.

2. Description of the Prior Art

In the past, natural curly hair commonly-called as a natural permanent wave has been cured into straight hair by using a permanent first agent for relieving a composition of hair, pulling hair in a manner so as to jerk it by a heated scissors-like iron to stretch the hair, and fixing this state by a permanent second agent. In the iron for the purpose so far used, both rod and glove are constituted of planes, constituted of planes and convex portions, and constituted of convex portions (roller). However, the above-described arrangement fundamentally merely heats hair, and the stretching is carried out by pulling a portion of hair having passed through and heated by the iron sandwiched by the iron.

This poses various problems such that a heavy burden is imposed on hair root, all hair cannot be gripped by a uniform force, an excessive tension is applied to a part of hair, and a gripping force is insufficient for a part of hair so that hair cannot be stretched sufficiently.

Recently, the irons of an improved type have been variously proposed, most of which have a constitution in which a passage through which hair passes is bent in a zigzag manner within the section of an iron, and jerking action is applied thereat, as in an iron disclosed, for example, in Japanese Utility Model Publication No. 48161/1995. However, in the iron just mentioned, when a rod and a glove are made of metal and hair is held by the metal surface, the adjustment of the force for gripping an iron is difficult, and a problem involves in evenness of the force applied to the gripped hair.

In view of the foregoing, the present inventor has proposed an arrangement in which the gripping portion for hair is constituted of an elastic material surface and convex portions (see Japanese Patent Publication No. 22082/1992).

However, in a combination of the elastic material surface and metal convex portions, since the convex portions are bited into the elastic surface, the gripping force is excessively strong so that hair is jerked more than as needed to impart pains, and the skin of hair tends to be damaged.

Above all, the above-described various irons have a problem in that straight hair is formed by pulling hair after having passed through the iron. That is, in the irons disclosed in the above-described Japanese Utility Model Publication No. 48161/1995 or Japanese Patent Publication No. 22082/1992, since no tension is exerted within the iron, curl within the longitudinal surface of the iron cannot be stretched but the iron has a mere function to form a ringlet as shown in FIG. 4 (*a*) into wavy hair as shown in FIG. 4 (*b*).

There is a proposal wherein straight hair is obtained by passing hair through an iron by a gripping force of the iron and exerting tension on hair after being heated. However, since hair moved out of the iron is rapidly cooled, large tension for stretching hair is necessary to impart pains to the skin.

SUMMARY OF THE INVENTION

This invention is to provide a curly hair curing iron in which a severe action is not imparted to hair by a jerking portion, and has a stretching function to make straight hair.

The curly hair curing iron according to this invention is a scissors-like iron having rods each having a heater housed therein, characterized in that a curly hair inlet side of the rod constitutes a hair jerking portion having a strong gripping force, and an outlet side thereof constitutes a stretching portion having a weaker gripping force than the jerking portion.

More specifically, a comb is formed on the inlet side of curly hair; a jerking portion comprises at least two convex portions which are trapezoidal or semicircular in section, and plane portions in engagement with the convex portions of the other rod; and both convex portions and plane portions in engagement with the convex portions are formed of an elastic material. And, an engaging portion at an extreme end of said convex portion has a width of not less than 0.5 mm but less than 3 mm.

On the other hand, in the stretching portion, one rod has a plurality of convex portions which are square or trapezoidal in section, while the other rod is constituted of a plane; and both convex portion and plane portion are formed of an elastic material. In the convex portion, the engaging portion with the plane portion has a width of not less than 1 mm but less than 5 mm.

As described above, the engaging surface of one rod have a plurality of convex portions which are trapezoidal or semicircular in section and the other rod has a plane portion in engagement therewith, and both convex portion and plane portion are formed of an elastic material. An engaging portion of the convex portion with the plane portion of the other rod has 0.5 mm to 5 mm of width, and a height thereof is preferably less than 2 mm.

The curly hair curing iron according to the present invention is constituted as described above. Referring to FIG. 1, hair is first curved and fixed in the shape of U or V by the convex portion and the plane portion of the jerking portion a, and the hair is pulled so as to subject to strong vertical jerking while being heated. Therefore, curly hair is stretched within the section of FIG. 1, but the jerking force in a direction vertical to paper surface is so weak that curly hair as shown in FIG. 4 (*a*) is cured into wavy hair as shown in FIG. 4 (*b*).

Then, the hair enters the stretching portion b. The width of the engaging portion of the convex portion in this portion b is wider than that of the engaging portion of the convex portion in the jerking portion, and one rod is plane so that the gripping force of hair is naturally weaker than the jerking portion. Therefore, in this portion, tension is exerted on hair by the gripping force of the jerking portion so that hair is stretched into wavy hair, and thence straight hair. However, different conventional articles, hair is formed into straight hair by tension still under heating and under action of pressing force by the convex portion. Since a relatively high curing force exerts locally, a force for pulling an iron may be small as compared with conventional articles, reducing a burden on the skin.

Hair entering an iron are let pass through a comb whereby the hair are arranged in parallel to evenly apply the aforementioned action to the hair, similarly to the previous inventions.

Generally, thickness or diameter of hair is not constant. When hair is firmly sandwiched by an iron, a strong pressing force exerts on large-diameter hair while a gripping force for small-diameter hair is insufficient. Therefore, the large-diameter hair is partly damaged in the skin while for the small-diameter hair, a gripping force is so weak that curing to straight hair is insufficient. In the iron according to the present invention, a main gripping force for hair is obtained by the convex portion in the jerking portion. However, a material for forming the convex portion is an elastic material, and as shown in FIG. 5, in a portion in which a gripping force is excessively large, an extreme end of the convex portion as shown in FIG. 5(*a*) is deformed as shown in FIG. 5 (*b*) to protect the skin from being damaged. It is therefore possible to exert even gripping force to all hair. However, if the height of the convex portion is too high, when deformed, the elastic material tends to be broken. Even if the elastic material is released, it cannot be returned to its original state. Therefore, the height of the convex portion is preferably less than 2 mm.

DETAILED DESCRIPTION OF THE PREFERRED EMBODIMENTS

The present invention will be described hereinafter in more detail by way of embodiments with reference to the drawings.

Figure 1:
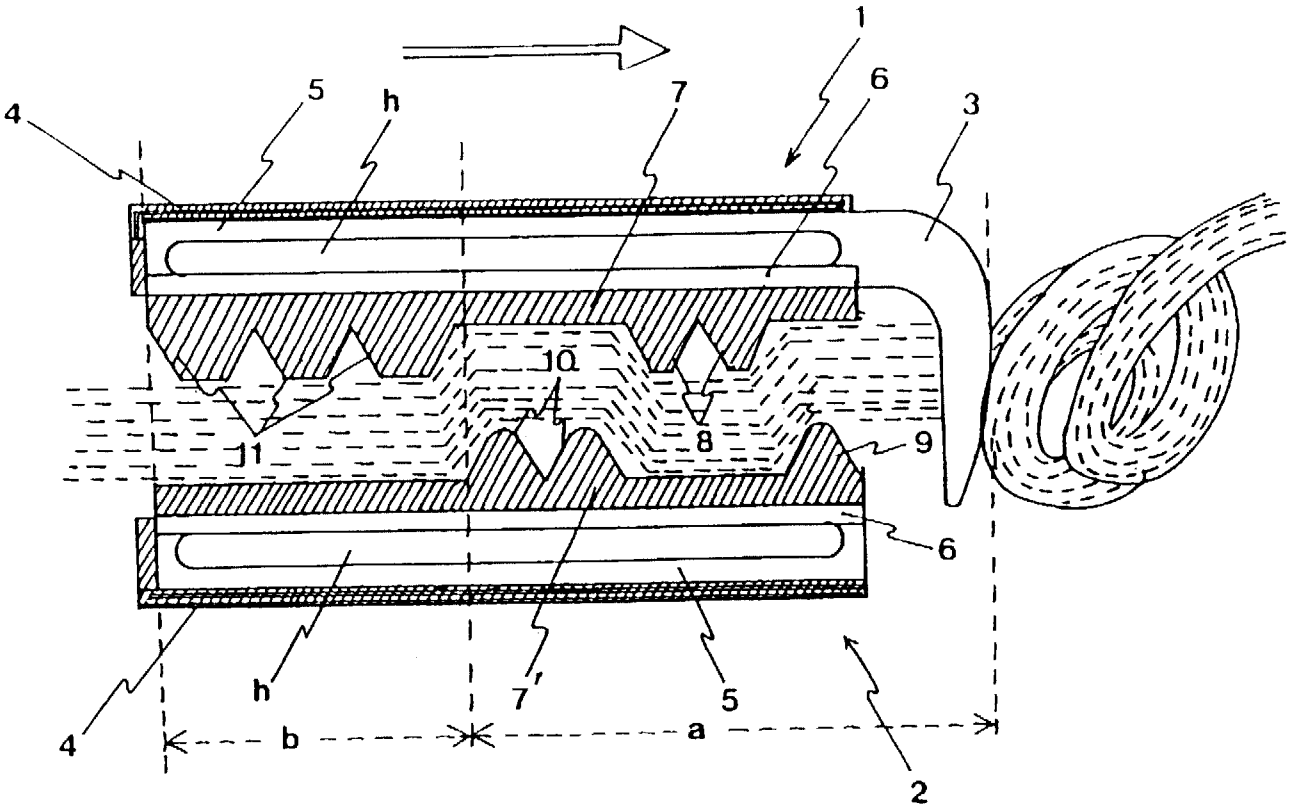
FIG. 1 is a sectional view of a rod according to one embodiment of a curly hair curing iron of the present invention.
Figure 2A:
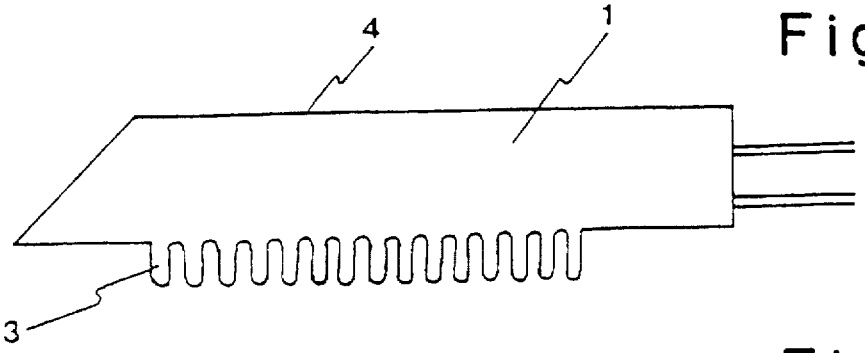
FIGS. 2 (*a*) and 2 (*b*) are a side view and a plan view, respectively, of one rod according to one embodiment of a curly hair curing iron of the present invention.
Figure 2B:
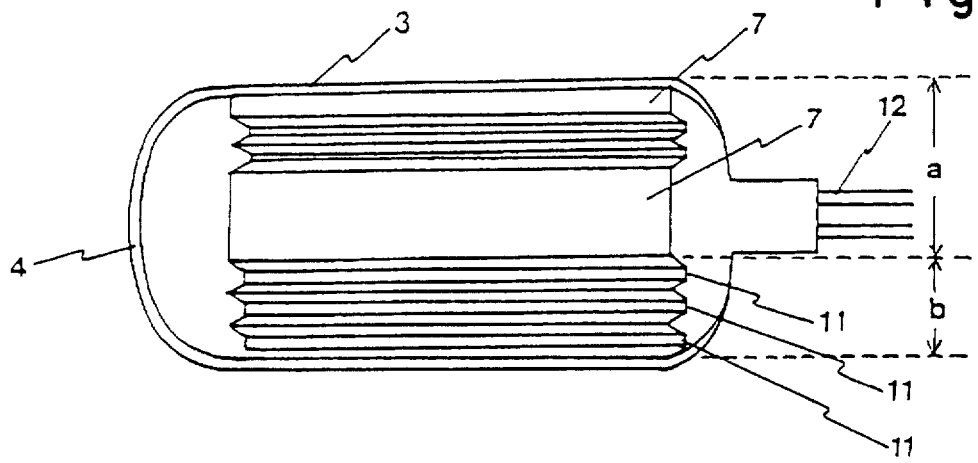
Figure 3A:
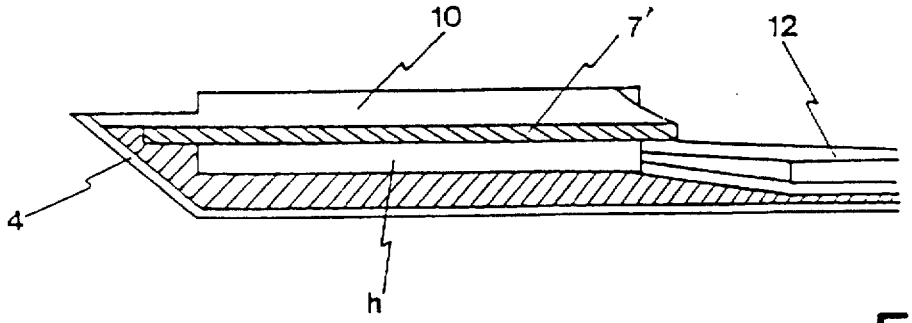
FIGS. 3 (*a*) and 3 (*b*) are a longitudinal sectional view and a plan view, respectively, of the other rod according to one embodiment of a curly hair curing iron of the present invention.
Figure 3B:
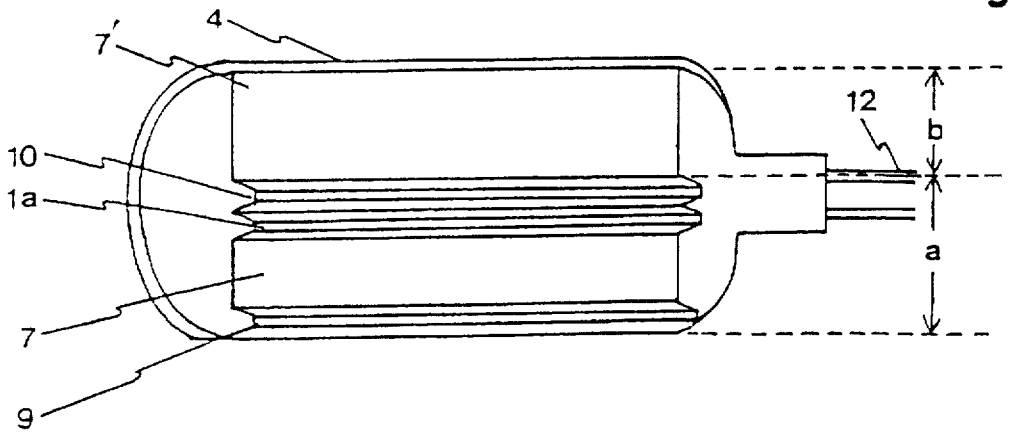

FIG. 1 is a sectional view of an iron according to the present invention with hair sandwiched; FIGS. 2 (*a*) and 2 (*b*) are a plan view on the sandwiching side of a rod 1 in FIG. 1 and a side view as viewed from a comb 3 provided on the side thereof, respectively; and FIGS. 3 (*a*) and 3 (*b*) are a plan view on the sandwiching side of a rod 2 and a sectional view thereof, respectively. When the iron is jerked in a direction indicated by arrow, a portion a following the comb 3 is a jerking portion, and a portion b is a stretching portion.

In both rods, a heater h having a cover 5 formed of a heat-resistant and insulating material is housed internally of a strength member 4 made of metal or other materials and is connected by wires 12 to a source of electricity. This insulating material is to prevent the surface of the iron from being risen in temperature and to prevent the head skin and hands from being burned. The internal surface 6 of the heater h is formed of metal such as copper to heat hair through sandwiching surfaces 7 and 7' of hair.

The sandwiching surfaces 7 and 7' of hair are made of heat resistant elastic plastics such as fluorine plastics, silicone, polyamide or the like. Two convex portions 8 in the shape of trapezoid in section are provided substantially in the center of the jerking portion a of the rod 1, and the surface of the rod 2 engaged with the convex portions 8 is planar. In the jerking portion a of the rod 2, convex portions 9 and 10 are provided on both sides of the plane portion and engaged with the plane portion of the rod 1. These two convex portions 9 and 10 are put side by side in order to increase a jerking force. The extreme end of the semicircular convex portion is not less than 0.5 mm but less than 3 mm in width and less than 2 mm in height.

In the stretching portion b, a convex portion 11 is provided on the rod 1 side, and the rod 2 side engaged therewith is plane. The extreme end of the convex portion 11 is plane, and the width thereof is wider than the extreme end of the jerking portion, not less than 1 mm but less than 5 mm. The section of the convex portion 11 is trapezoidal in the figure but may be of square in section. In the case where a weak stretching force will suffice, such a convex portion need not be provided but hair may be sandwiched between plane and plane.

Figure 4:
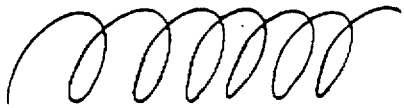
FIGS. 4 (*a*) and 4 (*b*) are respectively explanatory views showing shapes of curly hair.
Figure 4:
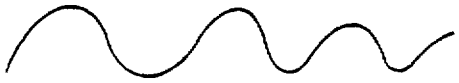
Figure 5A:
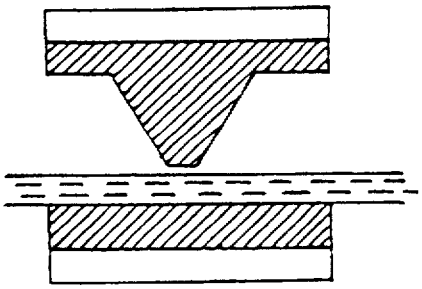
FIGS. 5 (*a*) and 5 (*b*) are respectively explanatory views showing the function of an elastic convex portion of a curly hair curing iron of the present invention.
Figure 5B:
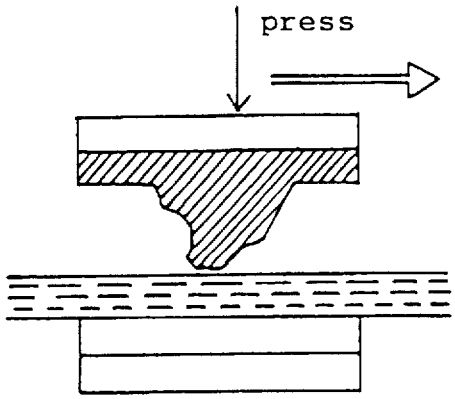

Curly hair subjected to reducing action with a permanent first agent is gripped, as shown in FIG. 1, by an iron held at a suitable temperature by the heater h by a controller, and the iron is pulled in a direction indicated by arrow. Then, curly hair which are often entangled each other are combed in parallel by the comb 3, and are subject to the jerking action while being bent vertically strongly by the convex portions 8, 9 and 10 between the latter and the plane portions opposite thereto, whereby side chains of hair components are cut, and curly hair as shown in FIG. 4 (*a*) are formed into wavy hair as shown in FIG. 4 (*b*).

Then, in the stretching portion b, the hair pass through straight on the plane, but the gripping force at that portion is weaker than the jerking portion a. Therefore, tension exerts on the hair while being pulled by the jerking portion so that the wavy curl vertical to paper surface in FIG. 1 are also stretched, which are moved out of the iron as straight hair. Therefore, it is not necessary to pull hair to naturally cool hair while keeping the shape of straight hair, as in the past, but a permanent second agent may be immediately fixed to shorten the work time.

As described above, in the iron according to the present invention, since the gripping surface of hair has an elasticity, even if the engagement of the iron is somewhat deviated, such a deviation can be absorbed to exert an even gripping force on hair. This leads to merits such that not only breakage or damage of hair can be lessened but also pains caused by pulling hair are much relieved as compared with convention articles.

Further, the present invention exhibits remarkable effects in that by the provision of the stretching portion for exerting tension on hair into straight hair, even spiral hair, tied hair and close ringlet which are strongest in curly hair can be stretched and fixed easily, and in addition, the hair tips which have been easily broken and hard to be stretched are well stretched and not returned to original curly hair even if shampooed.

It is to be noted that the number of the convex portions is not limited to that mentioned in the above embodiment but the design can be variously changed such that the number of convex portions is increased to strengthen the jerking force or the number of convex portions is increased or the width of the rod is widened to thereby strengthen the stretching force.

What is claimed is:

1. In a scissors type iron having rods each having a heater housed therein, a curly hair curing iron characterized in that engaging surfaces of two rods have a plurality of convex portions which are one of trapezoidal and semicircular in section and plane portions in engagement with convex portions of the other rod, both said convex portions and said plane portions are formed of an elastic material.

2. The curly hair curing iron according to claim 1, wherein an engaging portion of the convex portion with the plane portion of the other rod has 0.5 mm to 5 mm of width.

3. The curly hair curing iron according to claim 1, wherein a height of said convex portion is less than 2 mm.

4. The curly hair curing iron according to claim 1, wherein said elastic material is elastic plastics selected from the group consisting of fluorine plastic, silicone, and polyamide.

5. In a scissors type iron having rods each having a heater housed therein, a curly hair curing iron characterized in that a curly hair inlet side of the rod constitutes a hair jerking portion having a strong gripping force, and an outlet side thereof constitutes a stretching portion having a weaker gripping force than the jerking portion.

6. The curly hair curing iron according to claim 5, wherein a comb is formed on the inlet side of curly hair curing iron.

7. The curly hair curing iron according to claim 5, wherein said jerking portion comprises at least two convex portions which are one of trapezoidal and semicircular in section, and plane portions in engagement with the convex portions of the other rod.

8. The curly hair curing iron according to claim 7, wherein both said convex portions and said plane portions in engagement with said convex portions are formed of an elastic material.

9. The curly hair curing iron according to claim 8, wherein an engaging portion at an extreme end of said convex portion has a width of not less than 0.5 mm but less than 3 mm.

10. The curly hair curing iron according to claim 5, wherein in said stretching portion, one rod has a plurality of convex portions which are one of square and trapezoidal in section, while the other rod is constituted of a plane.

11. The curly hair curing iron according to claim 10, wherein both said convex portion and said plane portion are formed of an elastic material.

12. The curly hair curing iron according to claim 11, wherein a width of the engaging portion at the extreme end of said convex portion with said plane portion is wider than that of said jerking portion in said stretching portion.

13. The curly hair curing iron according to claim 11, wherein in said convex portion, the engaging portion with said plane portion has a width of not less than 1 mm but less than 5 mm.

* * * * *